United States Patent [19]

Newman et al.

[11] Patent Number: 4,503,905

[45] Date of Patent: Mar. 12, 1985

[54] METHOD OF MAKING CERAMIC CORE HEAT RECUPERATOR

[75] Inventors: Ray L. Newman, Towanda; David H. Hopkins, Camptown, both of Pa.

[73] Assignee: GTE Products Corporation, Stamford, Conn.

[21] Appl. No.: 561,844

[22] Filed: Dec. 15, 1983

[51] Int. Cl.[3] ..... F28F 9/00

[52] U.S. Cl. ..... 165/76; 165/82; 165/166

[58] Field of Search ..... 165/76, 82, 166

[56] References Cited

U.S. PATENT DOCUMENTS

| | | | |
|---|---|---|---|
| 4,262,740 | 4/1981 | Brune | 165/76 X |
| 4,279,297 | 7/1981 | Dziedzic et al. | 165/166 X |
| 4,333,522 | 6/1982 | Brune | 165/82 X |
| 4,362,209 | 12/1982 | Cleveland | 165/166 |

*Primary Examiner*—Allen M. Ostrager

*Attorney, Agent, or Firm*—James Theodosopoulos

[57] ABSTRACT

In the manufacture of a heat recuperator, a ribbed layered cross-flow ceramic core is inserted into a metal housing. The core has divider ribs in the air-flow layers to provide triple pass air flow through the core. There are triple pass gaskets on the air-in and air-out faces of the core, between said faces and cast ceramic landed surfaces of the housing.

6 Claims, 4 Drawing Figures

METHOD OF MAKING CERAMIC CORE HEAT RECUPERATOR

This invention concerns ceramic cross-flow heat recuperators. Such recuperators comprise a ceramic heat-exchanger core within a metal housing and are shown in U.S. Pat. Nos. 4,083,400, 4,130,160, 4,262,740, 4,279,297, 4,300,627, 4,333,522, 4,362,209 and 4,363,623. In such cores, air to be heated flows through ribbed layers in the core, and a hot exhaust gas flows orthogonally thereto through similar ribbed layers alternated therewith.

This invention is particularly concerned with a recuperator having a triple pass core, that is to say, a core in which the air passes thrice therethrough. Triple pass recuperators are shown in U.K. patent aplication No. 2,110,361A and U.S. Pat. No. 4,333,522. However, the recuperator of this invention is longer-lived and better sealed than such prior art triple pass recuperators.

A recuperator in accordance with this invention comprises a cross-flow ceramic core made up of ribbed layers and having six faces namely, an air-in face and an air-out face, a hot-gas-in face and a hot-gas-out face, and two solid faces. In the layers through which the air flows, there are divider ribs which separate said layers into three sections for triple pass flow. The core is disposed within a metal housing having six sides, namely, an air-in side and an air-out side, a hot-gas-in side and a hot-gas-out side, and two closed sides. The air-in and air-out sides have cast ceramic material thereat having landed surfaces thereon which are in gasket-sealing correspondence with the perimeters and divider-rib edges of the respective air-in and air-out faces of the core. The hot-gas-in and hot-gas-out sides of the housing have cast ceramic material thereat having landed surfaces thereon which are in gasket-sealing correspondence with the perimeters of the respective hot-gas-in and hot-gas-out faces of the core. The closed sides of the housing are in correspondence with the solid faces of the core, there being means therebetween for applying compression to said solid faces.

In one embodiment, a recuperator in accordance with this invention comprises a triple pass ceramic core having suitable triple pass gaskets on the air-in and air-out faces of the core and suitable gaskets on the hot-gas-in and hot-gas-out faces of the core. The metal housing is roughly cube shaped, with three of its six sides being open, two being closed and the remaining side having cast ceramic material formed thereon to provide triple pass flow. The three open sides are closed off by three suitable covers detachably fastened to the housing. The cover opposite said remaining side also has cast ceramic material formed thereon to provide triple pass flow. The other two covers have openings for hot gas flow in and out of the core. The two solid faces of the core are faced against the two closed sides of the housing, with spring means present to place said two solid faces under compression.

In the drawing,

FIG. 1 is an exploded view and

FIG. 2 a perspective view of a recuperator in accordance with this invention.

Figure 1:
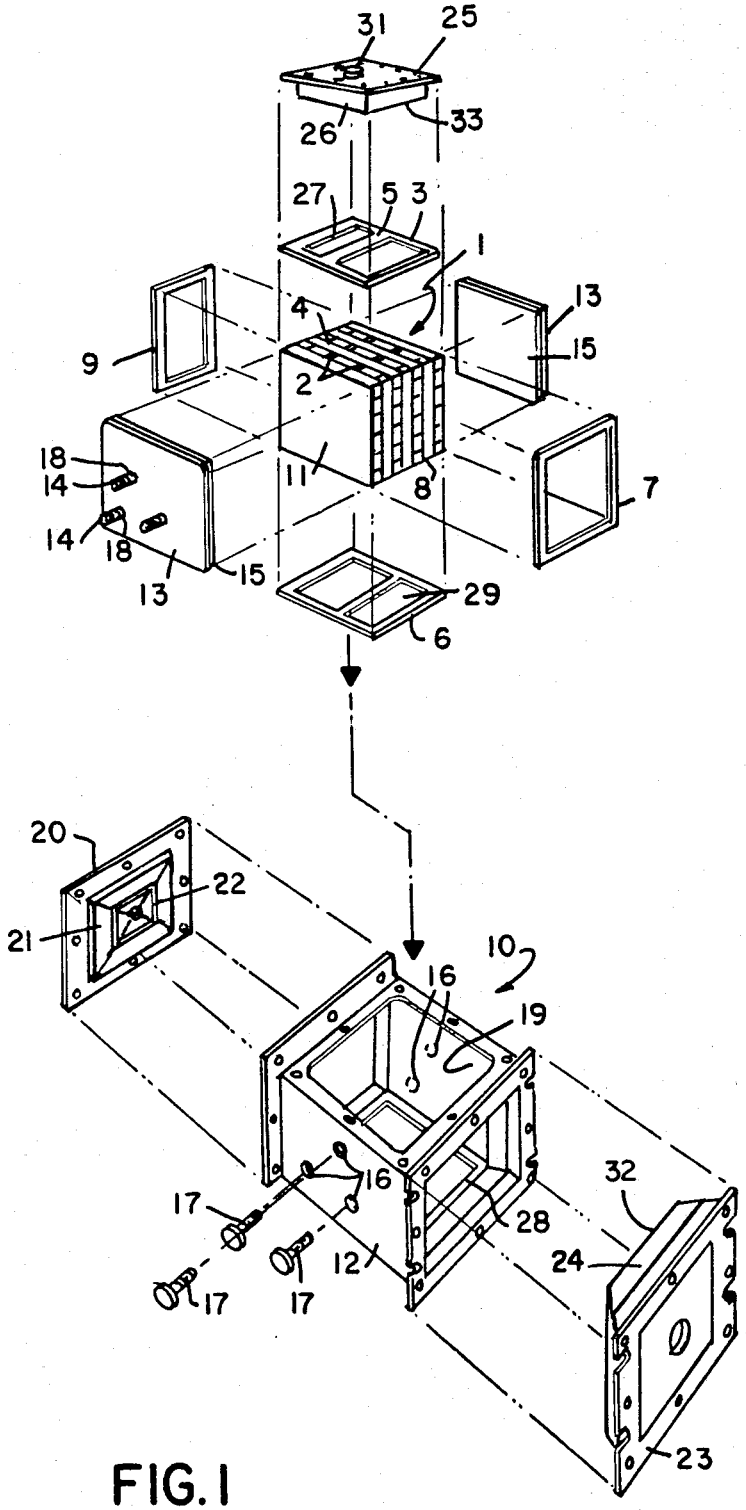
Figure 4:
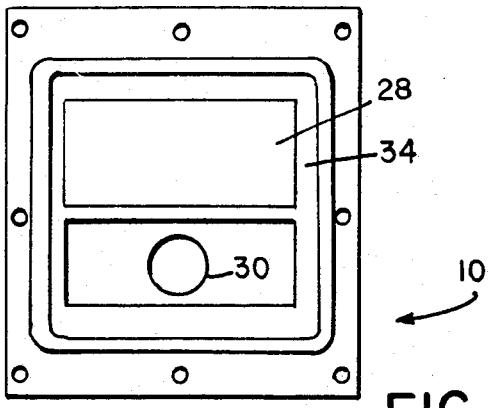
FIG. 4 is a top view of the recuperator showing the side which has cast ceramic material for triple pass flow.
Figure 3:
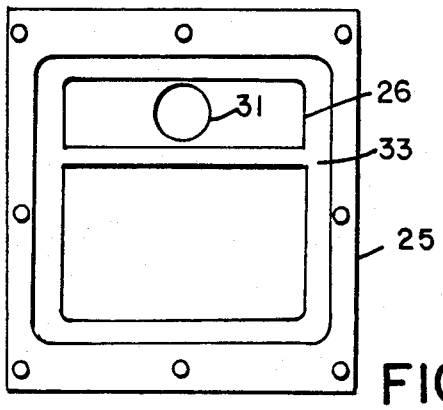
FIG. 3 shows the cover having cast ceramic material for triple pass flow.
Figure 2:
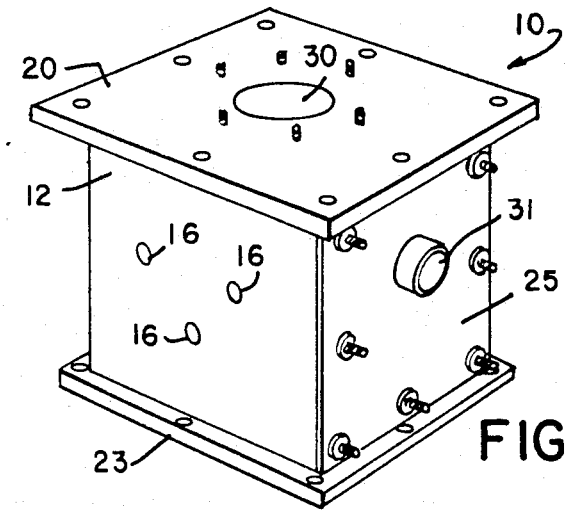

As shown in FIG. 1, a ceramic cross-flow core 1 in accordance with this invention comprises ribbed layers, the direction of flow in alternate layers being orthogonal to each other. The layers through which the air flows are divided into three sections so that the air passes thrice through said layers. In the layers through which the air flows, divider ribs 2 separate said three sections. A gasket 3 is disposed on air-in face 4 of core 1. Gasket 3 is substantially rectangular and abuts the solid-edged portion of core 1 at the perimeter of face 4. Gasket 3 also has a cross piece 5 which sealingly presses against the ends of divider ribs 2 to prevent air leakage between said sections. A similar gasket 6 is disposed on the air-out face of core 1.

A gasket 7 is disposed on hot-gas-in face 8 of core 1. Gasket 7 fits against the solid-edged portion of core 1 at the perimeter of face 8. A similar gasket 9 is disposed on the hot-gas-out face of core 1.

Core 1 fits within housing 10 as shown in FIG. 1. Solid face 11 of core 1 is faced against closed side 12 of housing 10. Disposed between face 11 and side 12 is a metal plate 13 which is pressed against face 11 by springs 14. Preferably a layer 15 of ceramic insulation is disposed between face 11 and plate 13. There is a similar arrangement between the other solid face of core 1 (not shown), which is opposite face 11, and closed side 19 of housing 10. At the time of inserting core 1 into housing 10, threaded bolts 17 are inserted into holes 16 on closed sides 12 and 19 and are threaded into threaded inserts 18 fastened to both metal plates (only plate 13 is shown) and around which are disposed helical springs 14. The heads of bolts 17 are larger than holes 16. Thus, as bolts 17 are threaded into inserts 18, the metal plates are retracted, that is, drawn towards closed sides 12 and 19, thus providing the necessary clearance to permit core 1 to be dropped into place within housing 10. After core 1 is in place, bolts 17 are removed, which permits the springs to press the plates against the solid faces of core 1.

The metal covers are then attached to housing 10. Cover 20 is the hot-gas-out cover and is detachably fastened to housing 10 by, for example, bolts. There is cast ceramic material 21 formed on metal cover 20 to substantially prevent contact of the hot gas with the metal and to provide a landed surface 22 that mates with gasket 9. Cover 23 is the hot-gas-in cover and is similarly attached to housing 10. Similarly, cover 23 has cast ceramic material 24 formed thereon, including landed surface 32, for the same purposes.

Cover 25 is the air-in cover and is similarly attached to housing 10. Cover 25 also has cast ceramic material 26 formed thereon to provide a landed surface 33 that mates with gasket 3 including cross piece 5. Cast material 26 is shaped to direct air flow entering from hole 31 into opening 27 of gasket 3 and down through the layers in the left hand section of core 1. Cast ceramic material 28 on the bottom side of housing 10 is shaped to redirect the air flow up through the layers in the middle section of core 1. Cast material 26 on cover 25 then redirects the air flow down through the layers in the right hand section of core 1, where the air flows through opening 29 of gasket 6 and out through hole 30. Cast ceramic material 28 has also landed surface 34 thereon that mates with gasket 6.

We claim:

1. The method of making a heat recuperator comprising a cross-flow ceramic core within a metal housing comprising the steps of:

(a) providing a ribbed layered cross-flow ceramic core having an air-in face and an air-out face, a hot-gas-in face and a hot-gas-out face, and two solid faces, alternate layers of the core being layers through which air flows and being separated by divider ribs into three sections so that the air passes thrice through said layers;

(b) providing a metal housing having an air-in side and an air-out side, a hot-gas-in side and a hot-gas-out side, and two solid sides;

(c) providing triple pass gaskets for the air-in and air-out faces of the core, there being a cross piece on each gasket for sealing against edges of the divider ribs;

(d) inserting the core into the housing;

(e) providing compression on the solid faces of the core by means of compression means disposed between said solid faces and the solid sides of the housing;

(f) providing cast ceramic material shaped to provide triple pass flow, and having landed surfaces thereon, at the air-in and air-out sides of the housing; and (g) sealing said triple pass gaskets between said air-in and air-out faces and said landed surfaces.

2. The method of claim 1 wherein said compression means comprises a helical spring and a metal plate disposed between each said solid face and respective solid side of the housing.

3. The method of claim 2 wherein each metal plate is retracted prior to insertion of the core into the housing.

4. The method of claim 3 wherein the means for retracting said metal plate comprises a threaded bolt extending through the solid side of the housing.

5. The method of claim 4 including the step of disengaging said bolt to release the metal plate from retraction and to apply compression to the solid faces of the core.

6. The method of claim 1 wherein the sealing of said triple pass gaskets is effected by attaching a cover to the housing, the cover having cast ceramic material thereon, the cast ceramic material having landed surfaces thereon, said landed surfaces mating with one of said triple pass gaskets.

* * * * *